US006672472B1

(12) United States Patent
Rockwood et al.

(10) Patent No.: US 6,672,472 B1
(45) Date of Patent: Jan. 6, 2004

(54) SOILED CLOTHING CONTAINER

(76) Inventors: Elayne D. Rockwood, R.R. 4, Box 173R, Lowville, NY (US) 13367; David A. Rockwood, R.R. 4, Box 173R, Lowville, NY (US) 13367

( * ) Notice: Subject to any disclaimer, the term of this patent is extended or adjusted under 35 U.S.C. 154(b) by 0 days.

(21) Appl. No.: 10/365,931

(22) Filed: Feb. 14, 2003

(51) Int. Cl.[7] ..... B65D 25/14
(52) U.S. Cl. ..... 220/495.08; 220/908.1
(58) Field of Search ..... 220/495.08, 495.06, 220/908.1; 280/47.18

(56) References Cited

U.S. PATENT DOCUMENTS

| | | | | |
|---|---|---|---|---|
| 1,421,628 A | | 7/1922 | Watkins | |
| 2,994,453 A | | 8/1961 | Gardiner | |
| 3,759,356 A | | 9/1973 | Bostick et al. | |
| 3,858,418 A | | 1/1975 | Butler | |
| 4,674,135 A | | 6/1987 | Greene | |
| 4,798,363 A | | 1/1989 | Cortesi | |
| 4,892,224 A | * | 1/1990 | Graham | 141/391 |
| 5,167,342 A | * | 12/1992 | Merritt | 220/495.08 |
| 5,636,871 A | * | 6/1997 | Field | 383/33 |
| 5,971,194 A | * | 10/1999 | Freedland | 220/495.08 |
| 6,026,972 A | * | 2/2000 | Makowski | 220/495.08 |
| D431,888 S | | 10/2000 | Roudebush | |
| 6,378,721 B1 | * | 4/2002 | Williams | 220/495.08 |

* cited by examiner

*Primary Examiner*—Joseph Man-Fu Moy
(74) *Attorney, Agent, or Firm*—Donald R. Schoonover

(57) ABSTRACT

A container houses a flexible bag into which soiled clothing can be deposited. The open end of the flexible bag is twisted relative to the closed bottom end of the flexible bag once the clothing has been deposited in the bag. This relative twisting will close the bag around the deposited item while leaving the open end of the bag open to receive further items. This process can be repeated until the bag is full, at which time, the bag can be removed from a container and discarded.

3 Claims, 1 Drawing Sheet

SOILED CLOTHING CONTAINER

BACKGROUND OF THE INVENTION

1. Field of the Invention

The present invention relates to the general art of containers, and to the particular field of waste containers.

2. Discussion of the Related Art

Some patients and residents of hospitals and adult care facilities sometimes wear disposable clothing, such as absorbent and/or disposable underwear or the like. This clothing often must be changed several times each day. Accordingly, these facilities have a problem with collecting, storing, and disposing such clothing after it has been soiled and discarded by the patient or resident. If not properly collected, stored, or disposed of, this clothing can create unpleasant odors or worse.

Therefore, many of these facilities hire special personnel to collect and discard such waste. Such tasks are generally carried out in various ways, none of which has proven to be totally acceptable. Anything that can be done to expedite this task would be a welcome improvement. Accordingly, there is a need for a means for efficiently and expeditiously collecting, storing, and discarding soiled and used clothing, such as underwear, at care facilities.

PRINCIPAL OBJECTS OF THE INVENTION

It is a main object of the present invention to provide a means for efficiently and expeditiously collecting, storing, and disposing of used and/or soiled undergarments, such as disposable underwear.

It is another object of the present invention to provide a means for efficiently and expeditiously collecting, storing, and disposing of used and/or soiled undergarments, such as disposable underwear in a manner that controls odor.

SUMMARY OF THE INVENTION

These, and other, objects are achieved by a waste container unit that permits a user to place trash, such as discarded disposable underwear, therein and which will seal the discarded item in a flexible trash bag. The trash bag will be closed to seal in odors, but will be able to accept further items until the bag is completely full. At that time, the entire bag can be discarded.

Using the container unit of the present invention, personnel can easily and expeditiously pick up and store discarded items, such as disposable underwear, and then dispose of such items.

BRIEF DESCRIPTION OF THE DRAWING FIGURES

DETAILED DESCRIPTION OF THE PREFERRED EMBODIMENT

Figure 3:
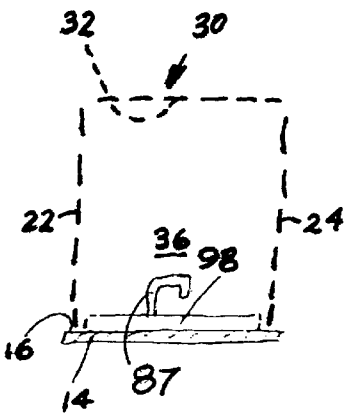
FIG. 3 is a side elevational view of a bottom element of the waste container unit of the present invention showing a friction-increasing element on the bottom element.

Other objects, features and advantages of the invention will become apparent from a consideration of the following detailed description and the accompanying drawings.

As shown in the figures, the present invention is embodied in a waste container unit 10 that is adapted to collect and store soiled clothing. Waste container unit 10 comprises a container body 12 which includes a bottom element 14 having an inside surface 16 and an outside surface 18, four side elements 20, 22, 24 and 26, each side element having an inside surface and an outside surface. A top element 30 has an inside surface 32 and an outside surface 34. An interior chamber 36 is defined by the inside surfaces of the bottom element 14 and the four side elements 20–26 and the top element 30.

A plurality of wheels, such as wheel 40, are mounted on the outside surface 18 of the bottom element 14. A longitudinal axis 42 extends between the top element 30 and the bottom element 14.

Figure 1:
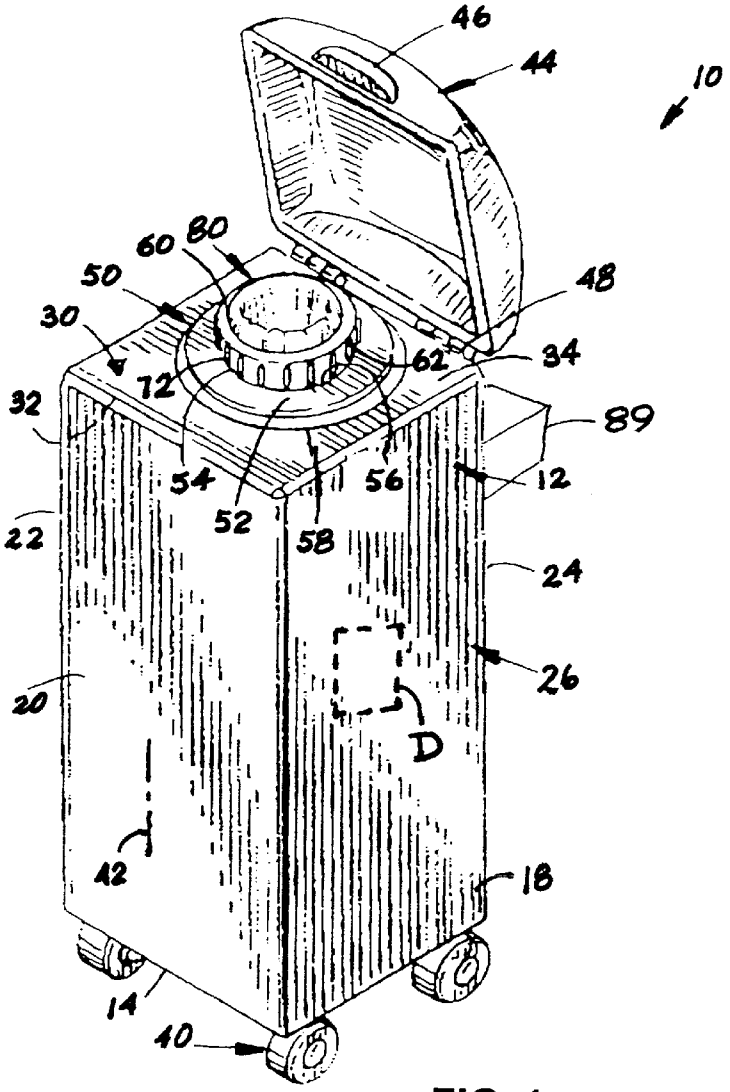
FIG. 1 is a perspective view of a waste container unit embodying the present invention.

A lid 44 having a hand grip element 46 thereon is hingeably attached to the container body 12 by a hinge element 48 located adjacent to the top element 30 to move from an open orientation shown in FIG. 1 to a closed orientation covering top element 30.

A cartridge holder unit 50 is mounted on the top element 30 of the container body 12 and includes an annular outer ring 52 fixedly mounted on the top element 30 of the container body 12. Outer ring 52 has a central opening 54 defined therethrough. The outer ring 52 has an inner perimeter 56 defined adjacent to the central opening 54 and an outer perimeter 58. Cartridge holder 50 can be removed from the container body 12 for a purpose that will be understood from the teaching in the following discussion.

A cartridge element 60 is rotatably mounted on the ring 52 of the cartridge holder unit 50. The cartridge element 60 includes an outer perimeter 62 movably engaging the inner perimeter 56 of the outer ring. The cartridge element 60 is cylindrical and has a first end 64, a second end 66, a cylindrical wall 68 and a longitudinal axis 70 which extends in the direction of the longitudinal axis 42 of the container body 12 and which also extends between the first end 64 of the cartridge element 60 and the second end 66 of the cartridge element 60. The cartridge element is rotatable about the longitudinal axis 70 of the cartridge element 60.

Elements, such as element 72, are located on the cartridge element 60 and frictionally engage the outer ring 52 adjacent to the central opening 54 of the outer ring 52 to hold the cartridge element 60 in place on the outer ring 52.

A bag cartridge 80 is fixedly mounted on the cartridge element 60 for rotation therewith. A flexible bag 82 is located in the interior chamber 36 of the container body 12. The flexible bag 82 has an open end 84 and a closed end 86 with the open end 84 of the flexible bag 82 being fixedly attached to the cartridge element 60 to be rotatable therewith. The closed end 86 of the flexible bag 82 is located adjacent to the inside surface 16 of the bottom element 14 of the container body 12. The soiled clothing container, 10 generally includes a mechanism, such as a hook-like element 87 attached to the bottom element 14 that passes through a loop 88 attached to the closed end 86 of the bag 82 or other suitable arrangement, for retaining the bag 82 in a distended or taunt configuration while the present invention 10 is in use. The present invention 10 may also include a holder 89 for carrying extra supplies, such as a roll of the bags 82.

Figure 2:
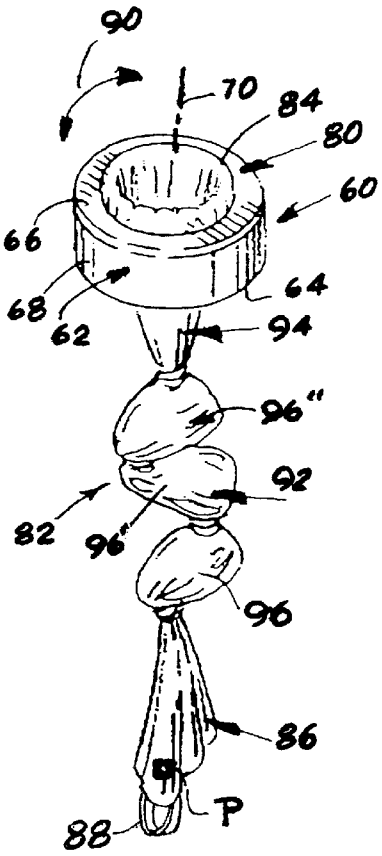
FIG. 2 is a perspective view of a flexible trash containing bag that is used in the waste container unit embodying the present invention.

As indicated in FIG. 2, when the cartridge unit 60 is rotated, as in direction 90, the open end 84 of the flexible bag 82 will rotate with respect to the closed end 86 of the flexible bag 82 thereby twisting the flexible bag 82 as indicated in FIG. 2 at twist 92. This closes part of the bag 82 while keeping the open end 84 of the flexible bag 82 open as indicated in FIG. 2 at location 94. An element, such as soiled clothing, can be dropped into the open end 84 of the flexible bag 82, and when the open end 84 of the bag 82 is rotated relative to the closed bottom 86 of the bag 82, the is item thus deposited in the bag 82 will be sealed in the twisted bag 82 as indicated at 96. Further items deposited in the bag 82 will force the first deposited item down toward the closed bottom 86 and will also be sealed in a twisted area as indicated in FIG. 2 at areas 96' and 96". This process is continued until the bag 82 is full. At that time, the bag 82 can be removed from the container body 12 via a door, such as a door D indicated in FIG. 1, or via the top element 30, or via an open area remaining after removal of cartridge holder 50, or the like, and then discarded. The flexible bag 82 is positioned in the container body 12 so the closed end 86 thereof is free to rotate. Thus, one form of the invention has the closed end 86 of the flexible bag 82 spaced apart from the inside surface 16 of the bottom element 14 of the container body 12. The flexible bag 82 can include odor-controlling substances, such as indicated by pellet P.

Twisting of the open top 84 of the flexible bag 82 relative to the closed bottom 86 of the bag 82 can be assisted by including elements on the inside surface 16 of the bottom element 14 of the container body 12, such as plate-like element 98, which will engage the closed bottom 86 of the flexible bag 82 and inhibit twisting movement of the bottom 86 of the 82 bag while the top 84 of the bag 82 is twisted. The element 98 would not necessarily support the bag 82, but merely engage it to inhibit the twisting of the closed bottom end 86.

It should now be obvious that the aforedescribed structure and twisting operation provided by the present invention 10 inhibits the release of odors into the ambient atmosphere from items disposed therein.

It is to be understood that while certain forms of the present invention have been illustrated and described herein, it is not to be limited to the specific forms or arrangements of parts described and shown.

What is claimed and desired to be covered by letters patent is:

1. A waste container unit for soiled clothing comprising:

a) a container body which includes (1) a bottom element having an inside surface and an outside surface, (2) four side elements, each side element having an inside surface and an outside surface, (3) a top element having an inside surface and an outside surface, (4) an interior chamber defined by the inside surfaces of the bottom element and the four side elements and the top element, (5) a plurality of wheels on the outside surface of the bottom element, and (6) a longitudinal axis extending between the top element and the bottom element;

b) a lid having a hand grip element thereon;

c) a hinge connecting said lid to said container body adjacent to the top element of said container body;

d) a cartridge holder unit mounted on the top element of said container body and including (1) an annular outer ring fixedly mounted on the top element of said container body and having a central opening defined therethrough, with the outer ring having an inner perimeter defined adjacent to the central opening and an outer perimeter, (2) a cartridge element rotatably mounted on the ring of said cartridge holder unit, the cartridge element including an outer perimeter movably engaging the inner perimeter of the outer ring, the cartridge element being cylindrical and having a first end, a second end, a cylindrical wall and a longitudinal axis extending in the direction of the longitudinal axis of said container body and extending between the first end of the cartridge element and the second end of the cartridge element, the cartridge element being rotatable about the longitudinal axis of the cartridge element, (3) elements on the cartridge element which frictionally engage the outer ring adjacent to the central opening of the outer ring, and (4) a bag cartridge fixedly mounted on the cartridge element for rotation therewith; and e) a flexible bag located in the interior chamber of said container body, said flexible bag having an open end and a closed end with the open end of said flexible bag being fixedly attached to said cartridge element to be rotatable therewith, the closed end of said flexible bag being located adjacent to the inside surface of the bottom element of said container body.

2. The waste container unit as described in claim 1 wherein the closed end of said flexible bag is spaced apart from the inside surface of the bottom element of said container body.

3. The waste container unit as described in claim 2 further including an odor-controlling substance in said flexible bag.

* * * * *